US005762840A

United States Patent [19]

Tsai et al.

[11] Patent Number: 5,762,840

[45] Date of Patent: Jun. 9, 1998

[54] PROCESS FOR MAKING MICROPOROUS FIBERS WITH IMPROVED PROPERTIES

[75] Inventors: Fu-Jya Tsai; Vasily Aramovich Topolkaraev, both of Appleton, Wis.

[73] Assignee: Kimberly-Clark Worldwide, Inc., Neenah, Wis.

[21] Appl. No.: 697,996

[22] Filed: Sep. 4, 1996

Related U.S. Application Data

[60] Provisional application No. 60/015,570, Apr. 18, 1996.

[51] Int. Cl.[6] ..... D01D 5/247

[52] U.S. Cl. ..... 264/41; 28/220; 28/240; 264/129; 264/154; 264/210.4; 264/210.5; 264/210.6; 264/210.7; 264/210.8; 264/235.6; 264/288.8; 264/289.6; 264/290.5; 264/346; 425/66; 425/71; 425/90; 425/93; 425/445

[58] Field of Search ..... 264/41, 129, 154, 264/210.4, 210.5, 210.6, 210.7, 210.8, 235.6, 288.8, 289.6, 290.5, 346; 425/66, 71, 90, 93, 445; 28/220, 240

[56] References Cited

U.S. PATENT DOCUMENTS

| | | | |
|---|---|---|---|
| 3,132,194 | 5/1964 | Edmonds, Jr. et al. | 264/37 |
| 3,215,486 | 11/1965 | Hada et al. | 8/74 |
| 3,375,208 | 3/1968 | Duddy | 260/2.1 |

(List continued on next page.)

FOREIGN PATENT DOCUMENTS

| | | |
|---|---|---|
| 1294180 | 1/1992 | Canada . |
| 1316314 | 4/1993 | Canada . |
| 77 509 | 10/1982 | European Pat. Off. . |
| 220 619 | 10/1986 | European Pat. Off. . |
| 256 717 | 2/1988 | European Pat. Off. . |
| 332 169 | 6/1989 | European Pat. Off. . |
| 194 926 | 6/1984 | Hungary . |
| 59-105035 | 6/1984 | Japan . |
| 63-252706 | 10/1988 | Japan . |
| 63-264336 | 11/1988 | Japan . |
| 64-9715 | 1/1989 | Japan . |
| 3-168230 | 7/1991 | Japan . |
| 6-24920 | 2/1994 | Japan . |
| WO 92/06577 | 4/1992 | WIPO . |
| WO 94/06849 | 3/1994 | WIPO . |

OTHER PUBLICATIONS

"Polyolefin Fibers Which Provide Anti–Strip To Asphalt Hot Mix And Process For Their Manuvacture," Research Disclosure, Apr. 1994, #36046, p. 221, disclosed by Hercules Incorporated, Wilmington, Delaware 19894–0001.

Volynskii, A. L., Yu. S. Belov, O. V. Arzhakova, L. M. Yarysheva, and N. F. Bakeev, "The Effect of Crystallization on the Mechanism of Drawing of Poly(ethylene Terephthalate) in Interactive Liquid Environments," *Polymer Science*, vol. 35, No. 7, 1993, pp. 913–917.

Germani, Mark S., "Application of Automated Electron Microscopy to Individual Particle Analysis," *American Laboratory*, Apr. 1993, pp. 17–24.

Vander Wood, T.B., "Introduction to Automated Particle Analysis," 52nd *Annual Meeting of the Microscopy Society of America*, San Francisco Press, Inc., San Francisco, Calif., 1994, pp. 398–399.

Nago, Satoshi and Yukio Mizutani, "Microporous Polypropylene Hollow Fibers Containing Poly (Methylsilsesquioxane) Fillers," *Journal of Applied Polymer Science*, vol. 53, 1994, pp. 1579–1587.

(List continued on next page.)

*Primary Examiner*—Leo B. Tentoni
*Attorney, Agent, or Firm*—Paul Yee

[57] ABSTRACT

A distinctive technique for making porous fiber includes a stretching of a substantially continuous fiber while the fiber is in an operative association with an effective quantity of surface-active material. The fiber can be produced from a source material which includes a thermoplastic, orientable material and at least about 0.35 weight percent (wt %) of a supplemental material. In particular configurations of the invention, the fiber may be contacted with a first quantity of surface-active fluid and at least a separate, second quantity of surface-active fluid. In other configurations, the fiber may be subjected to an additional incremental stretching.

25 Claims, 4 Drawing Sheets

U.S. PATENT DOCUMENTS

| | | | |
|---|---|---|---|
| 3,378,507 | 4/1968 | Sargent et al. | 260/2.5 |
| 3,407,151 | 10/1968 | Overcashier et al. | 260/2.5 |
| 3,536,796 | 10/1970 | Rock | 264/49 |
| 3,677,881 | 7/1972 | Riordon | 161/178 |
| 3,839,516 | 10/1974 | Williams et al. | 264/41 |
| 3,957,936 | 5/1976 | Lauchenauer | 264/53 |
| 4,001,367 | 1/1977 | Guthrie et al. | 264/154 |
| 4,013,617 | 3/1977 | Gordon et al. | 260/42.55 |
| 4,020,230 | 4/1977 | Mahoney et al. | 428/398 |
| 4,055,696 | 10/1977 | Kamada et al. | 428/398 |
| 4,055,702 | 10/1977 | Guthrie et al. | 428/398 |
| 4,076,656 | 2/1978 | White et al. | 260/2.5 M |
| 4,111,860 | 9/1978 | Jack | 521/84 |
| 4,115,492 | 9/1978 | Mahoney et al. | 264/49 |
| 4,257,997 | 3/1981 | Soehngen et al. | 264/145 |
| 4,290,987 | 9/1981 | Soehngen et al. | 264/41 |
| 4,401,567 | 8/1983 | Shindo et al. | 210/500.2 |
| 4,501,793 | 2/1985 | Sarada | 428/315.5 |
| 4,530,809 | 7/1985 | Shindo et al. | 264/210.7 |
| 4,541,981 | 9/1985 | Lowery et al. | 264/209.1 |
| 4,550,123 | 10/1985 | Lopatin et al. | 521/64 |
| 4,564,488 | 1/1986 | Gerach et al. | 264/41 |
| 4,594,202 | 6/1986 | Pall et al. | 264/8 |
| 4,594,207 | 6/1986 | Josefiak et al. | 264/41 |
| 4,652,412 | 3/1987 | Chiulli | 264/49 |
| 4,663,101 | 5/1987 | Kavesh et al. | 264/178 F |
| 4,670,341 | 6/1987 | Lundsager | 428/372 |
| 4,678,813 | 7/1987 | Itoh et al. | 521/61 |
| 4,708,800 | 11/1987 | Ichikawa et al. | 210/500.23 |
| 4,717,479 | 1/1988 | Itoh et al. | 210/490 |
| 4,726,989 | 2/1988 | Mrozinski | 428/315.5 |
| 4,734,196 | 3/1988 | Kono et al. | 210/500.36 |
| 4,734,324 | 3/1988 | Hill | 428/317.3 |
| 4,761,232 | 8/1988 | Bright | 210/500.36 |
| 4,791,144 | 12/1988 | Nagou et al. | 521/90 |
| 4,801,487 | 1/1989 | Kalus et al. | 428/206 |
| 4,815,714 | 3/1989 | Douglas | 264/22 |
| 4,824,499 | 4/1989 | Kagawa | 156/85 |
| 4,828,695 | 5/1989 | Yamamura et al. | 210/198.2 |
| 4,832,886 | 5/1989 | Douglas | 264/41 |
| 4,833,172 | 5/1989 | Schwarz et al. | 521/62 |
| 4,861,644 | 8/1989 | Young et al. | 428/195 |
| 4,869,821 | 9/1989 | Korin | 210/321.6 |
| 4,876,289 | 10/1989 | Itoh et al. | 521/54 |
| 4,877,679 | 10/1989 | Leatherman et al. | 428/224 |
| 4,878,974 | 11/1989 | Kagawa | 156/85 |
| 4,933,229 | 6/1990 | Insley et al. | 428/224 |
| 4,937,115 | 6/1990 | Leatherman | 428/36.4 |
| 4,957,787 | 9/1990 | Reinhardt et al. | 428/24 |
| 4,957,943 | 9/1990 | McAllister et al. | 521/64 |
| 4,959,208 | 9/1990 | Chakrabarti et al. | 424/78 |
| 4,959,396 | 9/1990 | Yankov et al. | 521/61 |
| 5,026,591 | 6/1991 | Henn et al. | 428/198 |
| 5,032,450 | 7/1991 | Rechlicz et al. | 428/196 |
| 5,035,886 | 7/1991 | Chakrabarti et al. | 424/78 |
| 5,047,283 | 9/1991 | Leatherman et al. | 428/209 |
| 5,059,630 | 10/1991 | Fujita et al. | 521/61 |
| 5,071,645 | 12/1991 | Johnson et al. | 424/486 |
| 5,093,197 | 3/1992 | Howard et al. | 428/372 |
| 5,096,640 | 3/1992 | Brody et al. | 264/49 |
| 5,114,438 | 5/1992 | Leatherman et al. | 51/296 |
| 5,126,219 | 6/1992 | Howard et al. | 429/252 |
| 5,130,342 | 7/1992 | McAllister et al. | 521/61 |
| 5,160,627 | 11/1992 | Cussler et al. | 210/639 |
| 5,196,262 | 3/1993 | Schwarz et al. | 428/315.5 |
| 5,198,162 | 3/1993 | Park et al. | 264/49 |
| 5,230,843 | 7/1993 | Howard et al. | 264/41 |
| 5,230,949 | 7/1993 | Howard et al. | 428/224 |
| 5,232,642 | 8/1993 | Kamo et al. | 264/41 |
| 5,238,623 | 8/1993 | Mrozinski | 264/48 |
| 5,238,735 | 8/1993 | Nagou et al. | 428/304.4 |
| 5,273,755 | 12/1993 | Venktrama et al. | 424/448 |
| 5,277,851 | 1/1994 | Ford et al. | 264/41 |
| 5,294,338 | 3/1994 | Kamo et al. | 210/321.8 |
| 5,294,346 | 3/1994 | Donato et al. | 210/645 |
| 5,298,348 | 3/1994 | Kung | 429/101 |
| 5,326,391 | 7/1994 | Anderson et al. | 106/409 |
| 5,344,702 | 9/1994 | Haubs et al. | 428/305.5 |
| 5,395,570 | 3/1995 | Kopp et al. | 264/41 |
| 5,435,955 | 7/1995 | Kamei et al. | 264/154 |
| 5,480,712 | 1/1996 | Takahashi et al. | 428/316.6 |
| B1 4,342,811 | 2/1985 | Lopatin et al. | 428/220 |

OTHER PUBLICATIONS

Nago, Satoshi and Yukio Mizutani, "Microporous Polypropylene Hollow Fibers With Double Layers," *Journal of Applied Polymer Science*, vol. 56, 1995, pp. 253–261.

Nago, Satoshi and Yukio Mizutani, "Microporous Polypropylene Sheets Containing Polymethylsilsesquioxane Filler," *Journal of Applied Polymer Science*, vol. 50, 1993, pp. 1815–1822.

PROCESS FOR MAKING MICROPOROUS FIBERS WITH IMPROVED PROPERTIES

This is a nonprovisional application claiming the benefit of copending provisional application No. 60/015,570 filed Apr. 18, 1996.

FIELD OF THE INVENTION

The present invention relates to the manufacture of synthetic fibers. More particularly, the invention relates to a method and apparatus for making synthetic fibers which are porous and exhibit improved mechanical properties.

BACKGROUND OF THE INVENTION

Porous films have been made by incorporating filler particles into a polymer material and stretching the material to form a film having voids induced. Such techniques, however, have not been adequate for forming small diameter porous fibers because the resultant fibers have been excessively large or have inadequate mechanical properties, such as low strength and low toughness.

Porous fibers have been made by employing conventional phase separation methods. Such methods generally involve mixing a polymer resin with a diluent or a plasticizer, quenching the polymer solution in a liquid medium to induce phase separation, and washing away the diluent to leave behind an interconnected porous structure. Other techniques have employed a blowing agent or a swelling agent to create a microporous structure. Still other techniques have employed an environmental crazing to prepare porous materials.

Conventional techniques, however, such as those described above, have not been able to produce porous fibers at sufficiently high speeds. In addition, the techniques have not adequately produced porous fibers having desired combinations of small diameter, high wettability, high permeability to liquid, high elongation and high tensile strength.

BRIEF DESCRIPTION OF THE INVENTION

Generally stated, the present invention provides a distinctive technique for making porous fiber. The technique includes a stretching of a substantially continuous fiber while the fiber is in an operative association with an effective quantity of surface-active material. The fiber can be produced from a source material which includes a thermoplastic, orientable material, and can include at least about 0.35 weight percent (wt %) of a supplemental material. In particular aspects of the invention, the fiber may be contacted with a first quantity of surface-active fluid. In other aspects, the fiber may be contacted with a first quantity of surface-active fluid and at least a separate, second quantity of surface-active fluid. In still other aspects, the fiber may be subjected to a selected plurality stretching operations.

In its various aspects, the technique of the invention can effectively and efficiently produce porous fibers at high speed. In particular aspects, the technique can produce fibers having desired combinations of small size, high wettability, high water-accessibility, high tensile strength, high elongation to break and improved ability to be further processed to form nonwoven fabrics and other articles of manufacture.

BRIEF DESCRIPTION OF THE DRAWINGS

The present invention will be more fully understood and further advantages will become apparent when reference is made to the followed detailed description of the invention and the drawings, in which.

DETAILED DESCRIPTION OF THE INVENTION

Figure 1:
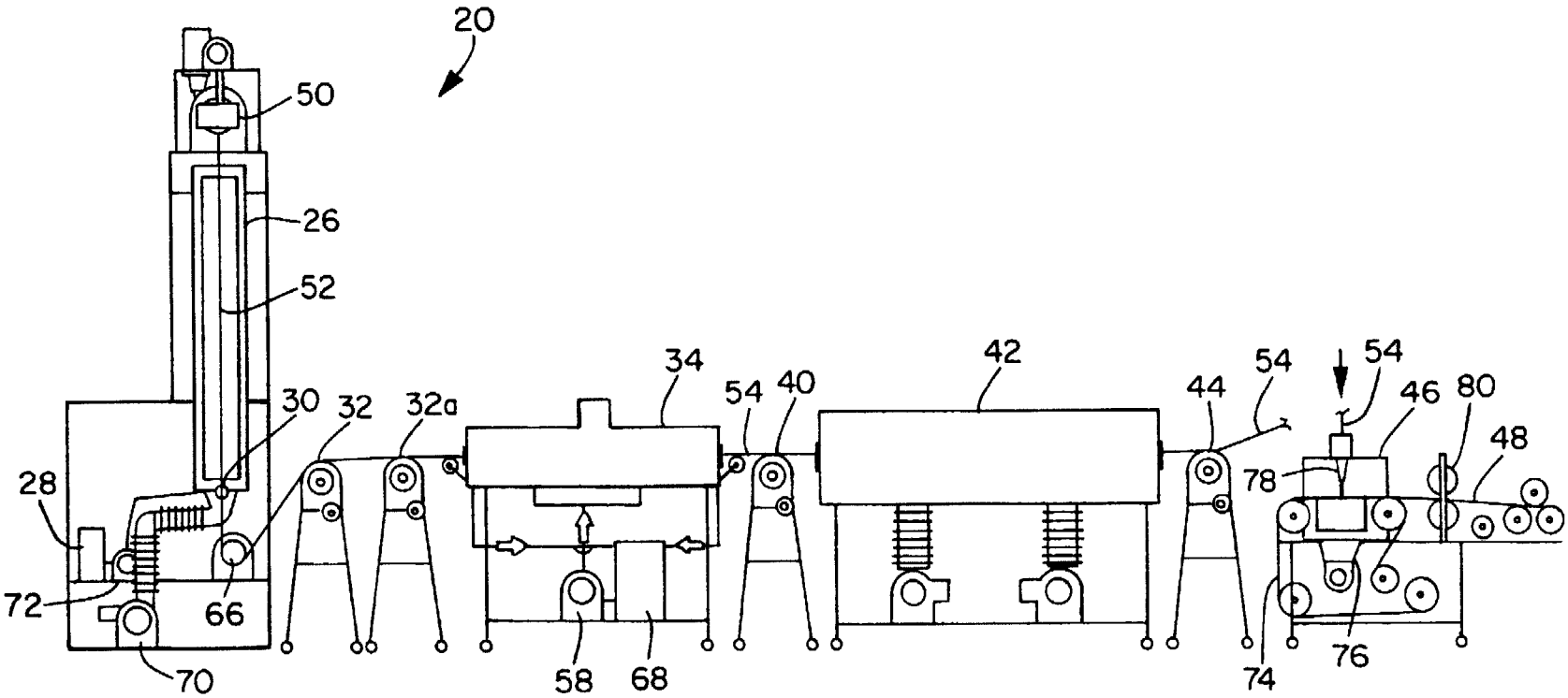
FIG. 1 shows a representative schematic view of the method and apparatus provided by the present invention.
Figure 2:
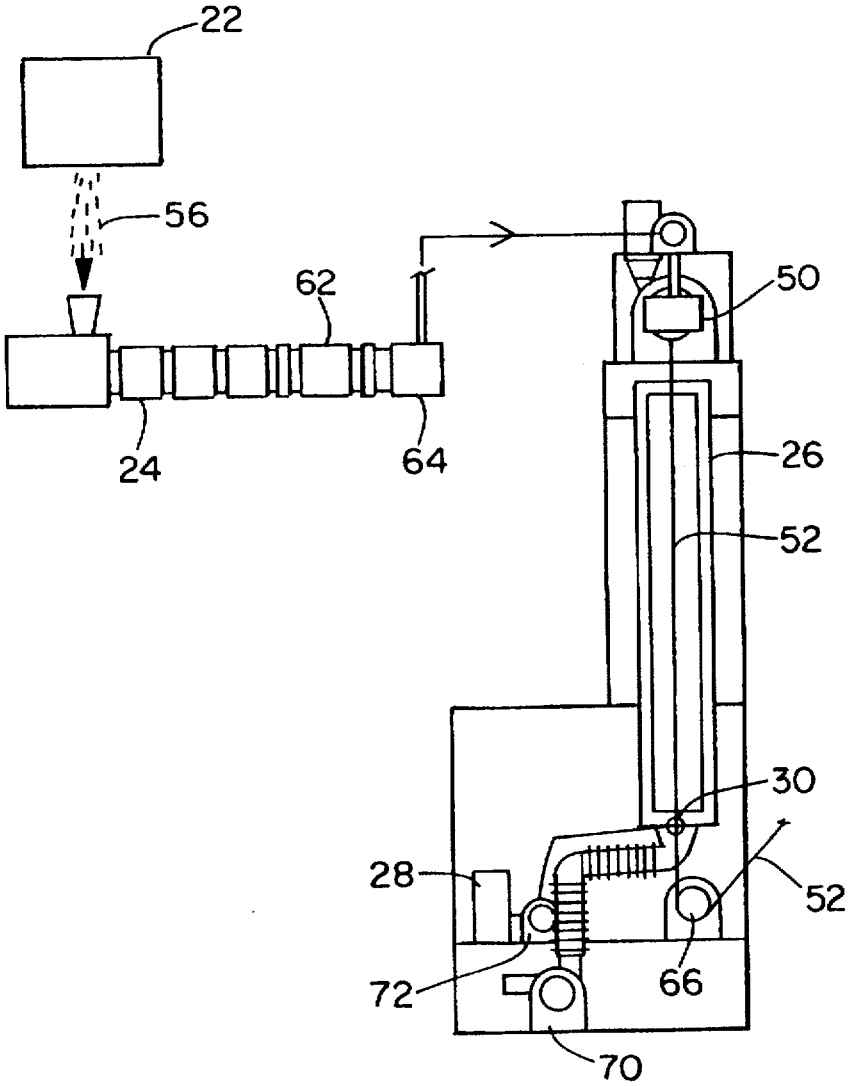
FIG. 2 shows a schematic view of representative fiber-forming, quenching and draw-down aspects of the invention.

With reference to FIGS. 1 and 2, a method and apparatus for making a porous fiber 54 provides for a stretching of a substantially continuous fiber 52 while the fiber 52 is in an operative association with an effective quantity of surface-active material. The fiber 52 is produced from a source material 56 which includes a thermoplastic, orientable material and can include at least about 0.35 weight percent (wt %) of a supplemental material, such as a filler material. The surface-active material may be operatively associated by incorporating the surface-active material in the source material prior to fiber forming, or by a separate contacting of the surface-active liquid onto already formed fiber. The stretching may be accomplished by any conventional stretching mechanism, such as aerodynamic stretching, a system of draw rolls or the like, as well as combinations thereof. In the representatively shown configuration, for example, the stretching can be performed by a system which includes a draw-down roll 66. The stretching and drawing system can also include additional drawing mechanisms, such as a system of draw rolls 32 and **32*a*, and/or draw roller 40**. In particular aspects of the invention, the fiber may be subjected to a selected plurality stretching operations.

A particular aspect of the technique of the invention can provide for a formation-stretching of a substantially continuous fiber 52 while the fiber 52 is in an operably effective contact with a formation-quantity of surface-active fluid, such as a surface-active liquid 36. The fiber 52 is produced from a source material 56 which includes a polymer material and at least about 0.35 weight percent (wt %) of a supplemental material. The fiber 52 has been pretreated with a first quantity of surface-active fluid, such as surface-active liquid 28, and has been incrementally stretched.

In the illustrated arrangement, the method and apparatus for making the porous fiber 54 includes a reservoir, such as hopper 22, which holds and delivers constituent component materials desired for producing the selected source material 56. The source material includes a thermoplastic, orientable material and at least about 0.35 wt % of a supplemental material, where the weight percentage is determined with respect to a total weight of the overall source material. A forming mechanism, such as provided by an extruder 24 and a fiber former 50, supplies substantially continuous fiber 52. The fiber 52 is pretreated with a first quantity of surface-active fluid, such as a first surface-active liquid 28. A first stretching mechanism, such as provided by a system which includes draw rolls 32 and **32*a*, incrementally stretches the pretreated fiber 52. The fiber 52 is placed in an operably effective contact with a second quantity of surface-active fluid, such as a surface-active fluid 36. A second stretching mechanism, such as provided by a second system which includes draw roller 40, formation-stretches the fiber 52** while the fiber is in the operably effective contact with the second quantity of surface-active fluid.

When producing porous polymer films, such as microporous polymer films, known conventional techniques have stretched films composed of precursor materials which have contained up to 65 wt % of filler materials. In the production of porous fibers, it has been difficult to form fibers while incorporating desired, effective amounts of filler materials, and it has been particularly difficult to produce fibers having a denier per fiber of less than about 50 denier under such conditions. Conventional fiber forming processes, such as those which employ stretching to generate pores, have typically been limited to incorporating less than 0.5 wt % of the desired filler material.

In the present invention, the source material 56 includes a thermoplastic, orientable materials, such as thermoplastic and orientable polymers, copolymers, blends, mixtures, compounds and other combinations thereof. Desirably, the thermoplastic materials do not include highly reactive groups.

In particular arrangements of the invention, the source material 56 can be a polyolefinic material. For example, the source material may include homopolymers of polyethylene or polypropylene, or may include copolymers of ethylene and polypropylene. In other arrangements, the source material may include another polymer material, such as a polyether, a copolyether, a polyamid, a copolyamid, a polyester or a copolyester, as well as copolymers, blends, mixtures and other combinations thereof.

The thermoplastic material is melt processible, and in particular aspects of the invention, the material can have a melt flow rate (MFR) value of not less than about 1 g/10 minutes (based on ASTM D1238-L). Alternatively, the MFR value can be not less than about 10 g/10 minutes, and optionally, can be not less than about 20 g/10 minutes. In other aspects of the invention, the MFR value can be not more than 200 g/10 minutes. Alternatively, the MFR value can be not more than about 100 g/10 minutes, and optionally, can be not more than about 40 g/10 minutes to provide desired levels of processibility.

Such melt processible, thermoplastic material can, for example, be provided by a homopolymer polypropylene. Commercially available polyolefins, such as Himont PF 301, PF 304, and PF 305, Exxon PP 3445, Shell Polymer E5D47, are also representative of suitable materials. Still other suitable materials include, for example, random copolymers, such as a random copolymer containing propylene and ethylene (e.g. Exxon 9355 containing 3.5% ethylene), and homopolymers, such as homopolymer polyethylene, which have MFR values similar to those mentioned herein. The polymer resins may contain small amounts (e.g. about 0.05 to 5 parts of additive to 100 parts of resin) of processing additives, such as calcium sterate or other acid scavengers. Other additives can include, for example, silicon glycol copolymers, organosilicone compounds, olefinic elastomers, and low molecular weight parafins or other lubricating additives. Various pigment additives may also be incorporated. For example, pigment concentrates such as a titanium dioxide pigment concentrate with low molecular weight polyethylene plasticizer can be employed as a processing additive. The various additives can have a plasticizing effect, can improve the strength and softness of the fiber, and can help facilitate one or more of the extrusion, fiber spinning, and stretching processes.

The source material 56 can also include a further supplemental material, and the supplemental material may include a filler material, and/or a surfactant or other surface-active material. The filler material can be a particulate material which can help provide porosity-initiating, debonding sites to enhance the desired formation of pores during the various stretching operations applied to the fiber 52. The filler material can help provide a desired surface-modified fiber, and can help enhance a desired "sliding effect" generated during subsequent stretching operations. In addition, the filler material help preserve the pores that are generated during the various stretching operations.

Where the supplemental material includes a surface-active material, such as a surfactant or other material having a low surface energy (e.g. silicone oil), the surface-active material can help reduce the surface energy of the fiber as well as provide lubrication among the polymer segments which form the fiber 52. The reduced surface energy and lubrication can help create the "sliding effect" during the subsequent stretching operations.

The supplemental filler material can be organic or inorganic, and the filler material is desirably in the form of individual, discrete particles. The fillers may be subjected to a surface treatment with various coatings and surfactants to impart an affinity to the polymer resin in the source material, to reduce agglomeration, to improve filler dispersion, and to provide a controlled interaction with fluids, such as body fluids, blood or water. Examples of an inorganic filler can include metal oxides, as well as hydroxides, carbonates and sulfates of metals. Other suitable inorganic filler materials can include, for example, calcium carbonate, various kinds of clay, silica, alumina, barium sulfate, sodium carbonate, talc, magnesium carbonate, magnesium sulfate, barium carbonate, kaolin, mica, carbon, calcium oxide, magnesium oxide, aluminum hydroxide, titanium dioxide, powdered metals, glass microspheres, or vugular void-containing particles. Still other inorganic fillers can include those with particles having higher aspect ratios, such as talc, mica, and wollastonite, but such fillers may be less effective. Representative organic fillers can include, for example, pulp powders, wood powders, cellulose derivatives, chitin, chitosan powder, powders of highly crystalline, high melting polymers, beads of highly crosslinked polymers, powders of organosilicones, and the like; as well as combinations and derivatives thereof.

In particular aspects of the invention, the fillers can have an average particle size which is not more than about 10 microns (μm). Alternatively, the average particle size can be not more than about 5 μm, and optionally, can be not more than about 1 μm to provide improved processibility. In other aspects of the invention, the top cut particle size is not more than about 25 μm. Alternatively, and the top cut particle size can be not more than about 10 μm, and optionally can be not more than about 4 μm to provide improved processability during the formation of fibers having the desired size and porous structure. The fillers may also be surface-modified by the incorporation of surfactants, and/or other materials, such as stearic or behenic acid, which can be employed to improve the processibility of the source material.

Examples of suitable filler materials include one or more of the following:

(1) Dupont R-101 $TiO_2$, which is available from E.I. DuPont de Nemours, and can be supplied in a concentrate form by Standrich Color Corporation, a business having offices located in Social Circle, Ga. 30279. This material can provide good processibility.

(2) Pigment Blue 15:1 (10% copper), which is distributed by Standridge Color Corporation. Fibers produced with this material may break more often.

(3) OMYACARB®UF $CaCO_3$, which is available from OMYA, Inc., a business having offices located in Proctor, Vt. 05765. This material can have a top cut particle size of about 4 μm and a average particle size of about 0.7 μm, and can provide good processibility. This filler can be coated with a surfactant, such as Dow Corning 193 surfactant, before the compounding or other combining with the source material 56. The filler can also be coated with other appropriate surfactants, such as those mentioned elsewhere in the present description.

(4) OMYACARB®UFT $CaCO_3$ coated with stearic acid, which is available from OMYA, Inc. This material can have a top cut particle size of about 4 μm and a mean particle size of about 0.7 μm, and can provide good processibility.

(5) SUPERCOAT™ $CaCO_3$ which is available from ECC International, a business having offices located in Atlanta, Ga. 30342, 5775 Peachtree-Dunwoody Road. This material can have a top cut particle size of about 8 μm and a mean particle size of about 1 μm. Fibers produced with this material may break more often.

(6) Powdered polydimethyl silsesquioxane (#22 or #23 Dow Coming Additive), which is available from Dow Corning, a business having offices located in Midland, Mich. 48628-0997. This material can provide good processibility, while some agglomerations may be observed.

The supplemental material can optionally include a surface-active material, such as a surfactant or other material having a low surface energy (e.g. silicone oil). In particular aspects of the invention, the surfactant, or other surface-active material, can have a Hydrophile-Lipophile Balance (HLB) number which is not more than about 18. Alternatively, the HLB number is not more than about 16, and optionally is not more than about 15. In other aspects of the invention, the HLB number is not less than about 6. Alternatively, the HLB number is not less than about 7, and optionally the HLB number is not less than about 12. When the HLB number is too low, there can be insufficient wettability. When the HLB number is too high, the surfactant may have insufficient adhesion to the polymer matrix of the source material, and may be too easily washed away during use. The HLB numbers of commercially available surfactants can be found in McCUTCHEON's Vol 2: Functional Materials, 1995.

A suitable surfactant can include silicon glycol copolymers, carboxilated alcohol ethoxylates, various ethoxylated alcohols, ethoxylated alkyl phenols, ethoxylated fatty esters and the like, as well as combinations thereof.

Other suitable surfactants can, for example, include one or more of the following:

(1) surfactants composed of ethoxylated alkyl phenols, such as IGEPAL RC-620, RC-630, CA-620, 630, 720, CO-530, 610, 630, 660, 710 and 730, which are available from Rhone-Poulenc, a business having offices located in Cranbury, N.J.

(2) surfactants composed of silicone glycol copolymers, such as Dow Corning D190, D193, FF400, and D1315, which are available from Dow Corning, a business having offices located in Midland, Mich.

(3) surfactants composed of ethoxylated mono- and diglycerides, such as Mazel 80 MGK, Masil SF 19, and Mazel 165C, which are available from PPG Industries, a business having offices located in Gurnee, Ill. 60031.

(4) surfactants composed of ethoxylated alcohols, such as Genapol 26-L-98N, Genapol 26-L-60N, and Genapol 26-L-5, which are available from Hoechst Celanese Corp., a business having offices located in Charlotte, N.C. 28217.

(5) surfactants composed of carboxilated alcohol ethoxylates, such as Marlowet 4700 and Marlowet 4703, which are available from Huls America Inc., a business having offices located in Piscataway, N.J. 08854.

(6) ethoxylated fatty esters, such as Pationic 138C, Pationic 122A, and Pationic SSL, which are available from R.I.T.A. Corp., a business having offices located in Woodstock, Ill. 60098.

The source material 56 includes not less than about 0.35 wt % of the supplemental material, where the weight percentage is determined with respect to the total weight of the combined source material. In particular aspects of the invention, the amount of supplemental material is not less than about 0.5 wt %, and may desirably be at least about 1 wt %. Alternatively, the amount of supplemental material is not less than about 5 wt %, and optionally is not less than about 10 wt %. In other aspects of the invention, the amount of supplemental material can up to about 50 wt % or more. The amount of supplemental material is desirably not more than about 30 wt %. Alternatively, the amount of supplemental material can be not more than about 20 wt % and optionally can be not more than about 15 wt %.

In particular aspects of the invention, the source material 56 can include not less than about 0.35 wt % of the filler material. In particular aspects of the invention, the amount of filler material is not less than about 0.5 wt %. Alternatively, the amount of filler material is not less than about 1 wt %, and optionally is not less than about 5 wt %. In other aspects of the invention, the amount of filler material can up to about 50 wt % or more. The amount of filler material may desirably be not more than about 30 wt %. Alternatively, the amount of filler material can be not more than about 20 wt % and optionally can be not more than about 10 wt %.

In further aspects of the invention where the supplemental material includes a surface-active material, the amount of surface-active material, such as surfactant, is at least about 0.1 wt %. Alternatively, the amount of surface-active material is at least about 1 wt %, and optionally, is at least about 3 wt %. In other aspects of the invention, the amount of surface-active material is not more than about 20 wt %. Alternatively, the amount of surface-active material is not more than about 15 wt %, and optionally, is not more than about 10 wt %.

The selected source material is operably transported or otherwise delivered to a mechanism which converts the source material 56 into one or more individual strands or filaments of substantially continuous fiber 52. In the representatively shown configuration, the selected component materials are delivered to the extruder 24 which further processes the component materials to form the desired fiber-forming material. The component materials are suitably melted and intermixed, and the resultant material is extruded through a suitable fiber former 50 to generate a single fiber or a selected plurality of individual, fiber filaments or strands.

The component materials employed to form the source material for the fiber may be suitably intermixed or otherwise combined at various locations along the method and apparatus. For example, the component polymer materials and supplemental materials may be combined at a mixer prior to melting. Alternatively, the components may be combined in a mixer after melting, and optionally, may be combined within the extruder 24. In addition a combination of such mixing techniques may be employed. Desirably, the components are combined in a single screw or twin-screw extruder, and the extruder can further include a static mixer to provide improved process efficiency due to improved dispersion of the filler and surfactant materials, and due to reduced agglomerations in the extruded material.

An example of a suitable extruder is an extruder with a screw diameter of 19 mm, and a length/diameter (L/D) ratio of about 24/1. Such an extruder is available from Alex James & Associates, Inc., a business having offices in Greenville, S.C. With reference to FIG. 2, the extruder 24 can include a conventional, on-line static mixer 62. Suitable static mixers are available from Koch Engineering Company, Inc., a business having offices located in Wichita, Kans.

From the extruder 24, the extrudates are delivered by a conventional metering pump 64 to the fiber former 50. Various types of conventional fiber forming mechanisms may be employed. A suitable fiber former can, for example, be provided by a conventional spinpack device, such as a spinning plate having a nozzle with approximately 15 holes, each hole having a diameter of about 500 μm. Such mechanisms are available from the above-mentioned Alex James & Associates, Inc.

The selected, first surface-active fluid 28 is delivered from a suitable supply reservoir 60 by a conventional metering pump 72 through a suitable conduit 74 to an applicator 30 contained within an environmentally controlled chamber 26. The first, surface-active fluid may be a liquid, vapor or gas, and in the shown arrangements, the surface-active fluid is a liquid. The surface-active fluid advantageously reduces the surface energy between the fiber material polymer and its immediate environment. Desirably the surface-active fluid material can provide for a low surface energy which is less than the critical surface energy of the polymer of the fiber material.

The dependence of the size of the initiated micropores upon the surface energy and the draw stress applied to the fiber can be described by the Griffith criterion, which pertains to the tensile stress ($\sigma$) associated with the loss in stability of microdefects. The criterion relates the tensile stress ($\sigma$) to the size "r" of the microdefects in the fiber material and the surface energy ($\gamma$) between the fiber material and the environment. According to the Griffith criterion, $$\sigma=(4\ Y\gamma/r)_{1/2};$$

where:

Y=Young's modulus of the fiber material;

$\gamma$=surface energy between the fiber material and the environment;

r=size of the microdefect; and $\sigma$=stress associated with the loss in stability of a microdefect with size "r".

Thus, the lower the surface energy ($\gamma$) between the material and environment, the lower the stress ($\sigma$) required to create a micropore in a material having Young's modulus of "Y". In the present invention, the number of the initiated pores per unit area can be increased due to the smaller dimensions of the microdefects involved in the process of forming the micropores. The surface-active material employed in the various aspects of the invention can also have a plasticizing effect which can improve the drawing of the fibers and can enhance the desired formation of micropores in the fibers. The present invention can create a porous fiber structure with lower applied stress by employing processing steps which can more efficiently and more effectively take advantage of a reduced surface energy which has been provided between the target, fiber polymer material and its immediate environment.

In the various configurations of the invention, suitable surface-active materials are capable of reducing the surface energy of the fiber material. Desirably the surface-active fluid material is capable of providing for a surface tension which is less than the critical surface tension of the fiber material. In particular aspects of the invention, the selected surface-active fluid can be configured to provide for a surface tension which is less than the critical surface tension of the thermoplastic, orientable polymer material employed to form the fiber 52. For example, where the polymer is polyethylene with a surface tension of about 31 dynes/cm, the surface-active fluid can be selected to provide for a surface tension which is less than the 31 dynes/cm. Similarly, where the polymer is polypropylene with a surface tension of about 30 dynes/cm, the surface-active fluid can be selected to provide for a surface tension which is less than the 30 dynes/cm.

Desired surface-active and/or plasticizing environments can, for example, be provided by the operative presence of various alcohols, e.g. n-propanol; organic solvents and plasticizing fluids, e.g. heptane; and various supercritical fluids which are known to exhibit a unique combination of solvent and transport properties. Other examples of suitable surface-active fluids include, for example, pure isopropanol, isopropanol with a small amount of water (e.g. less than 10 wt % water), and/or any other fluids or fluid mixtures which can provide for an operative surface tension.

The representatively shown environmental chamber 26 is constructed and arranged to provide controlled conditions under which the nascent fiber 52 can be quenched, drawn-down, pretreated or otherwise preconditioned for further processing. More particularly, the interior of the chamber 26 provides a quenching zone in which the extruded fiber polymer cools and further solidifies. In the illustrated configurations, for example, the chamber 26 subjects the fiber polymer to ambient atmospheric pressure and provides a quenching zone length of about 122 cm (about 48 in). Within the quenching zone, the nascent fiber is cooled with circulating dry air, and the quenching air is directed by a conventional circulation system, such as a system which includes a blower fan 70. The air is operably projected with a flow rate and velocity which are sufficient to provide adequate cooling and quenching. The resultant air flow desirably has a vector component of velocity aligned substantially perpendicular to the direction of the fiber travel through the chamber 26. In addition, the air is sufficiently dry to allow an effective quenching, draw-down and pretreatment of the fiber polymer. Suitable temperatures for the cooling air can be within the range of about 5° C. to about 120° C. Desirably, the temperature is between room temperature and 80° C.

While the nascent strands of the fiber 52 are being quenched, the first surface-active fluid 28 is directed onto the fiber polymer material by the applicator 30 to provide an effective pretreatment of each fiber strand. The application of the surface-active fluid 28 helps to maximize the pore formation in the individual filaments of fiber 52, and the fluid can be applied by any conventional technique. For example, the fluid 28 can be directed and deposited by a conventional kiss-roll system, by a conventional spraying system or by a conventional nozzle and associated metering system. The representatively shown configuration employs a metering pump 72 and an applicator 30 to deposit an effective amount of a liquid, surface-active fluid 28. The metering pump 72 may, for example, be of the type available from Zenith Pump Division, Parker-Hannifin Co., a business having offices in Sanford, N.C. For the applicator 30, various types of conventional devices, such as a metering coating die or a finishing applicator, may be employed. The devices are typically used to apply liquid treatments onto textile fibers, and are well known in the textile art. Examples of suitable devices are of the type available from Petree & Stoudt Associates, Inc., a business having offices located in High Point, N.C. Such Petree & Stoudt devices have, for example, been identified with part No. 3,94370/45 and part No. 3,94137.

The shown configurations of the invention employ a surface-active fluid 28 which is in liquid form. Desirably, the liquid is a solution which contains not more than about 15 wt % of surfactant. If the relative amount of the surfactant to the solvent exceeds 15 wt %, the resulting fiber strands may become too sticky for handling in the subsequent processes. During the pretreatment by the surface-active liquid, the liquid is at a temperature below the boiling point of the liquid. Desirably, the temperature of the liquid is between the ambient room temperature and the boiling point of the liquid.

The applicator 30 delivers the first surface-active fluid 28 onto each individual, nascent strand of fiber 52 to effectively "lubricate" the polymer segments in the fiber material during the quenching operation before the fiber strands completely solidify. Where the surface-active fluid is applied while the fiber is in its softened nascent condition, the surface-active liquid can more readily diffuse or otherwise penetrate into the body of the fiber. Alternatively, however, the surface-active fluid can be applied to the fully solidified fiber to provide an effective modification of the surface of the fiber. In the various configurations of the invention, the operative association of surface-active fluid with the fiber material can advantageously lower the levels of applied stress which are needed during subsequent processing to form fiber having the desired porous structures.

During the cooling and quenching of the fiber strands, the strands can also be drawn and elongated. In the shown configurations, the appointed draw-down of the fiber strands can be accomplished as the fiber strands move within the environmental chamber 26 from the fiber former 50 onto and then around a draw-down roll 66. The roll 66 can also be configured to be a quench roll to provide a further cooling and solidification of the fiber strands. A conventional driving system, such as provided by an electric motor or the like, operatively rotates the draw-down roll to provide a selected, peripheral surface speed at the outer cylindrical surface of the rotating draw-down roll. Concurrently, the fiber strands are being move out of the fiber former at an operative fiber forming speed. The fiber forming speed is configured to be less than the surface speed of the draw-down roll, and as a result, the fiber strands are subjected to a tensioning and elongation. The quotient of the draw-down roll surface speed divided by the fiber forming speed can be referred to as the draw-down ratio provided by the draw-down process. In general, the draw-down ratio helps to control the strength of the nascent fiber. A higher draw-down ratio can increase the stress-induced crystallization within the fiber, and thereby increase the fiber strength. It is, however, important to limit the draw-down ratio to retain adequate distributions and quantities of amorphous regions to allow a more effective penetration of the surface-active fluid into the fiber during the various stretching operations.

Particular aspects of the invention can provide for a draw-down ratio which is not less than about 5. Alternatively, the draw-down ratio is not less than about 7, and optionally, is not less than about 10. In other aspects, the draw-down ratio can be not more than about 1,000. Alternatively, the draw-down ratio can be not more than about 500, and optionally can be not more than about 350 to provide improved process effectiveness.

The resultant, pretreated fiber 52 is delivered to a first elongating mechanism for stretching the fiber. For example, the first elongating mechanism can be provided by a first system of draw rolls which includes draw rolls 32 and **32*a*. The draw rolls 32 and/or 32*a*** can be a heated roller for imparting a desired drawing temperature to the fiber strands.

In addition, a conventional driving system, such as provided by an electric motor or the like, operatively rotates each of the draw rolls 32 to provide a selected, peripheral surface speed at the outer cylindrical surface of each rotating draw roll. The surface speed provided on the roll 32, however, is arranged to be less than the surface speed provided on the draw roll **32*a*. As a result, the fiber strands are subjected to a tensioning and elongation. The quotient of the surface speed at the relatively downstream draw roll 32*a* divided by the surface speed at the relatively upstream draw roll 32*a* can be referred to as the "draw ratio" imparted to the incremental stretching operation generated by the representative, cooperating system of rolls 32 and 32*a***.

In a particular aspect of the invention, the draw or stretching system provided by rolls 32 and **32*a* can be constructed and arranged in a conventional manner to generate a draw ratio for the incremental stretching operation which is not less than about 1. Alternatively, the draw ratio can be not less than about 1.1, and optionally, is not less than about 1.2. In other aspects, the incremental-stretching draw ratio can be not more than about 10. Alternatively the draw ratio can be not more than about 5, and optionally can be not more than about 2.5 to provided desired effectiveness The resultant stretching mechanism provides for a preliminary, incremental stretching of the strands of fiber 52, and the stretching can be conducted in an ambient atmosphere. The incremental stretching can effectively create microvoids or interlamellar volumes (void spaces between lamella crystals) within the individual fiber strands. As a result, the incremental stretching can advantageously increase the effectiveness of the formation-stretching operation. Without the incremental stretching, the more crystalline structure of the fibers may retard the penetration of a second surface-active fluid into the interior regions of the fiber, and may reduce the efficiency of the formation-stretching step. With the incremental stretching, the invention can advantageously create a precursor fiber structure which can better facilitate and accept a desired penetration of the formation-quantity of surface-active liquid 36** during the additional, formation-stretching operation.

In the representatively shown configurations, the incremental stretching is performed between at least one set of conventional godet rolls. Alternatively, the incremental stretching can be performed between a plurality of two or more sets of the godet rolls, and optionally can be performed by any other operative, fiber-drawing system. The incremental stretching can be done by a single stretching step, or by a selected serial plurality of individual, discrete stretching steps. Desirably, the incremental stretching is conducted at a drawing temperature which is at least about 0° C. Alternatively, the drawing temperature is at least about 10° C., and optionally is at least about 18° C. In other aspects, the drawing temperature is not more than about 170° C. Alternatively, the cold stretching and drawing temperature is not more than about 150° C., and optionally is not more than about 80° C. When drawing temperature is too high, some fibers may have a tendency to become tacky and may become difficult to handle.

In the shown configuration, the incrementally stretched strands of fiber are operably directed into a formation-stretching operation which incorporates a distinctly designed, stretching bath structure 34, which can be equipped with a selected formation-stretching or drawing system. The representatively shown elongating or drawing system includes the draw roll 32*a* positioned generally adjacent a relatively upstream end of the bath structure and a subsequent draw roller 40 positioned generally adjacent a relatively downstream end of the bath structure. In the shown arrangements, the draw roller 40 is provided by at least one conventional godet roll, and optionally may be provided by a plurality of godet rolls. Alternatively, the formation-stretching may be performed by any other operative fiber drawing system. In addition, the formation-stretching can be done by a single stretching step, or by a selected plurality of individual, discrete stretching steps.

In the various arrangements of the invention, the formation-stretching is conducted while the individual fiber strands are located in an operative and effective contact with the second, formation-quantity of the surface-active fluid 36. The surface-active fluid 36 can be selected from the various types of materials employed to provide the first surface-active fluid 28, and may be in the form of a liquid, vapor or gas. In the representatively shown configurations, the surface-active fluid 36 is in the form of a liquid which is delivered from and recirculated through a supply reservoir 68 by a pump 58. In particular aspects, the surface-active liquid can be a solution which contains less than about 15 wt % of surfactant. If the relative amount of the surfactant to solvent exceeds 15 wt %, the resulting fiber strands may become too sticky for handling during subsequent processing.

Where the surface-active fluid 36 is a vapor or gas, the temperature of the fluid is maintained high enough to sustain the vapor or gas phase during the formation-stretching operation. Where the surface-active fluid 36 is a supercritical fluid, the temperature and pressure of the fluid are maintained at levels which sustain the supercritical phase during the formation-stretching operation. Where the surface-active fluid 36 is a liquid, the liquid is maintained at a temperature which is less than boiling point of the liquid, but is sufficiently high to provide for a surface energy which is less than the critical surface energy of the fiber material. With higher temperatures of the liquid, the surface energy provided by the surface-active liquid typically decreases. As a result, the surface-active liquid can more effectively and more quickly penetrate into the fiber material, and enhance the desired pore formation.

Figure 3:
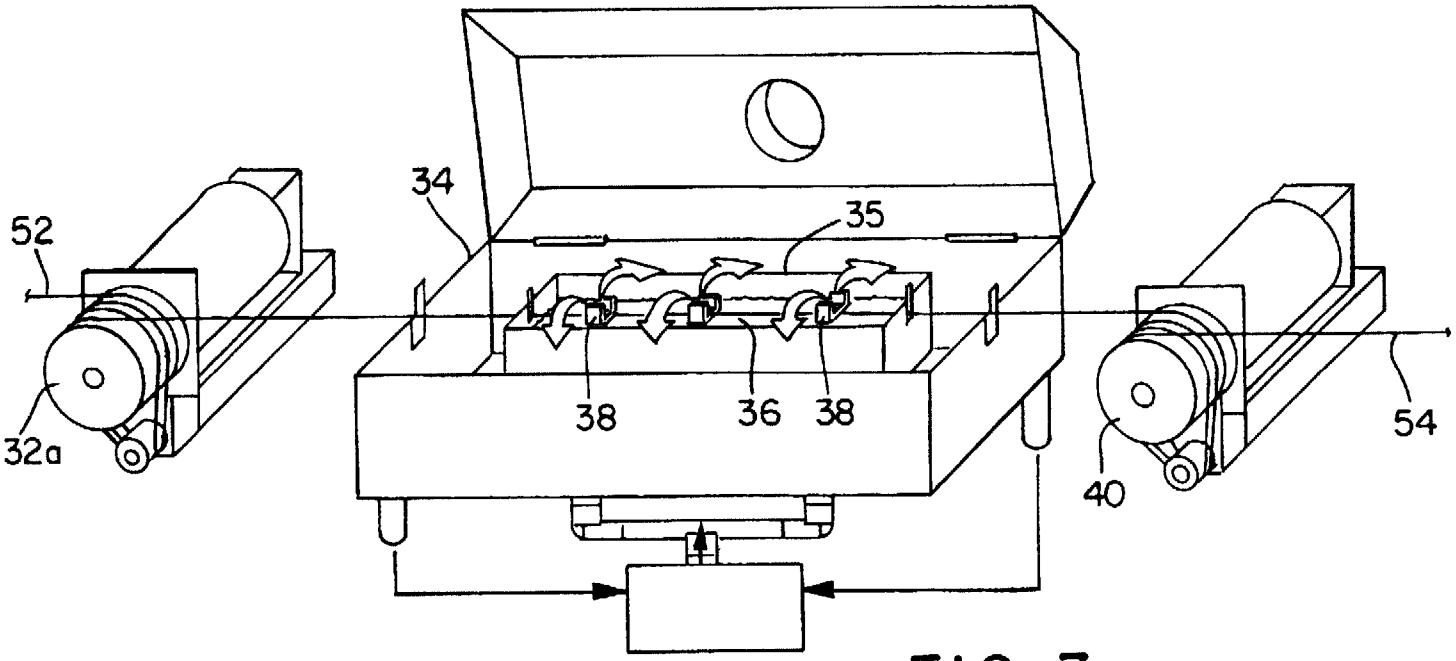
FIG. 3 shows a representative technique for subjecting the polymer fiber to a liquid bath of surface-active fluid.

A schematic diagram of a particular configuration of the formation-stretching operation is representatively shown in FIGS. 1 and 3. The arrangement is configured to reduce the contact of the fiber with the bulk of the formation-stretching liquid, and to reduce the resistance to the movement of the strands of fiber 52 through the process caused by such contact. The formation-stretching liquid can be brought into contact with the fiber by threading the fiber strands through a bath applicator 38 in which the liquid level can be controlled in a manner which substantially completely wraps the fiber with a thin-layer of the surface-active, stretching liquid. With reference to FIG. 3, the formation-stretching liquid is brought into contact with the fiber by threading fiber through one or more block applicators 38 which are composed of polytetrafluoroethylene (PTFE) and have a slit through which the surface-active liquid is metered and pumped to contact the fiber 52 during the formation-stretching operation. Optionally, the surface-active liquid may be sprayed onto the fiber strands.

In the shown configurations, the stretching bath mechanisms are of the type which are available from Alex James & Associates, Inc. The bath mechanism can include a circulation pump 58 and an appropriate system of conduits to operatively deliver to the selected applicator 38 an adequate quantity of the liquid selected to provide the second, surface-active fluid 36.

While the strands of the fiber 52 are disposed in the operable contact with the second surface-active liquid 36, the fiber is formation-stretched with a second stretching mechanism, such as a mechanism provided by the illustrated system of draw rollers 40 and 32*a*. The draw rollers 40 and 32*a* can be configured in a manner similar to that provided to the system of draw rolls employed for the previously described incremental stretching operation. Accordingly, a conventional driving system, such as provided by an electric motor or the like, operatively rotates each of the draw rollers 40 and 32*a* to provide a selected, peripheral surface speed at the outer cylindrical surface of each rotating draw roll. The surface speed provided on the first roller 32*a*, however, is arranged to be less than the surface speed provided on the second roller 40. As a result, the fiber strands located between the draw rollers are subjected to a tensioning and elongation. The quotient of the surface speed at draw roller 40 divided by the surface speed at draw roller 32*a* can be referred to as the draw ratio provided to the formation-stretching operation by the system of draw rollers comprising rollers 32*a* and 40.

In a particular aspect of the invention, the formation-stretching system of draw rollers, such as provided by roll 32*a* and roller 40, are operated in a conventional manner to generate a formation stretching ratio which is not less than about 1. Alternatively, the draw ratio can be not less than about 1.1, and optionally, is not less than about 1.2. In other aspects, the formation-stretching draw ratio can be not more than about 10.

Alternatively the draw ratio can be not more than about 5, and optionally can be not more than about 2.5 to provided desired effectiveness The formation-stretching of the fiber 52 can improve the ability to create a sufficiently extensive and large microporous structure within the fiber strands while employing the relatively low levels of tensile stress imparted by the technique of the present invention.

The formation stretched, porous fibers 54 can then be delivered to a heat setting operation, such as a heat setting provided by a heating oven 42. The heat-setting step may be optional when the strands of fiber 52 are composed of particular types of materials, such as a polyolefin material, but may be required when the fiber strands are composed of other materials, such as a polyester. The heat setting operation can help preserve the porous structure produced within the fiber strands, and can help protect the resulting structure against shrinkage, especially when the porous fiber in intended for use in extremely hot weather. Suitable heat setting temperatures can be within the range of about 20° C. up to the melting temperature of the polymer material employed to form the fiber 52. For example, heat setting temperatures within the range of about 60° C. to about 120° C. have been found to be desirable. During the heat setting operation, a set of tensioning rollers 44 is employed to substantially avoid shrinkage of the fiber and to effectively maintain the porous structure within the fiber 54 during the heat setting.

In its various aspects, the present invention can advantageously provide porous fiber having relatively low diameter and denier. In particular aspects, the porous fiber can have a fiber denier of not more than about 2000. Alternatively, the porous fiber denier can be not more than about 500, and optionally can be not more than about 50. In other aspects, the porous fiber can have a denier of about 0.5, or less, and optionally can have a denier of about 0.1, or less.

The various aspects of the invention can further be configured to deliver the porous fiber 54 at a process rate of at least about 900 meters/minute (m/min). Alternatively, the porous fiber can be delivered at a rate of at least about 1200 meters/minute, and optionally can be delivered at a rate of at least about 1500 meters/minute. In other aspects of the invention, the porous fiber 54 can be delivered at a rate within the range of up to about 3000 meters/minute. Alternatively, the porous fiber can be delivered at a rate of up to about 4000 meters/minute, and optionally can be delivered at a rate of up to about 12,000 meters/minute.

The porous fiber 54 can be delivered to a conventional take-up winder to generate fiber filament on a bobbin. Suitable take-up winders include those available from LEESONA, Inc., a business having offices located in Burlington, N.C.

Figure 4:
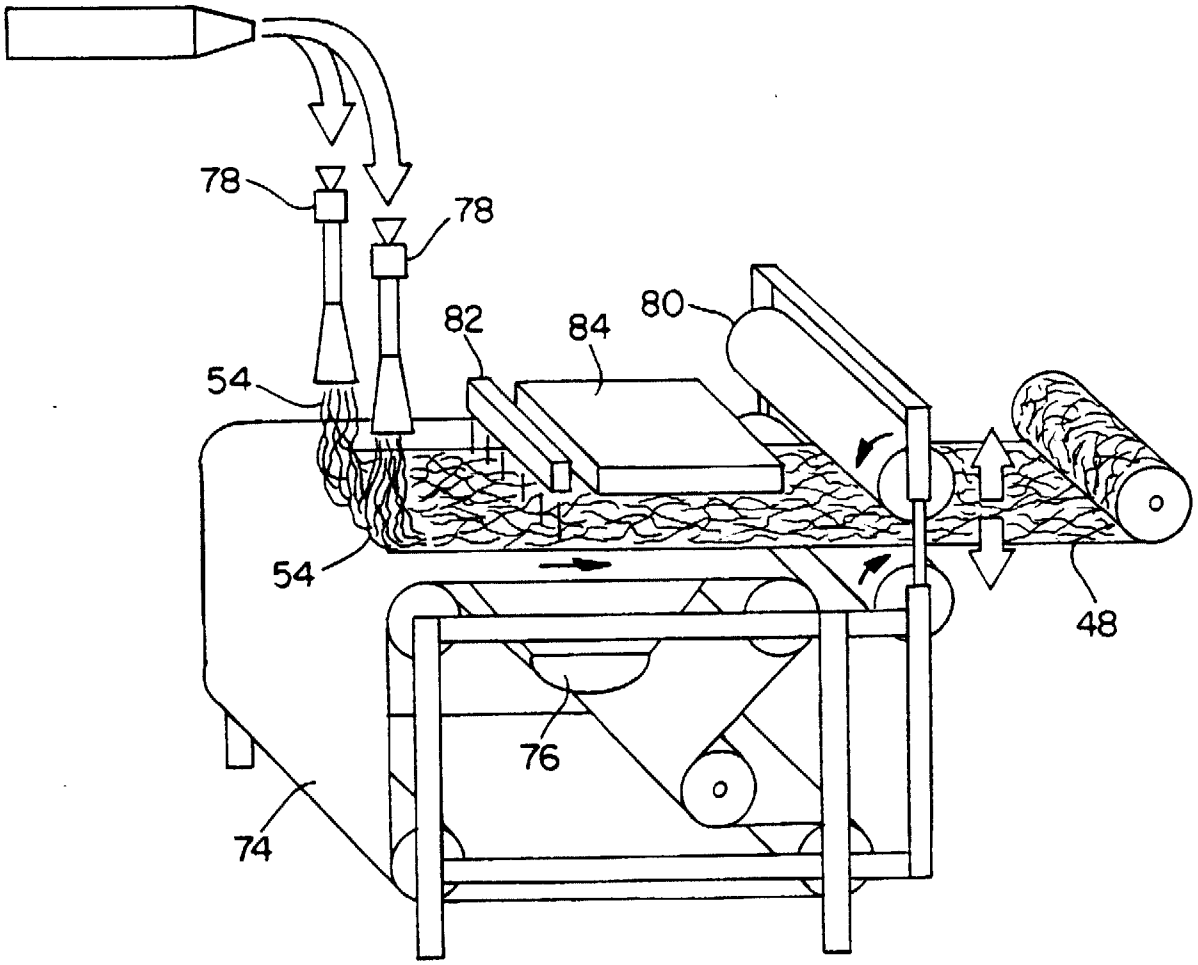
FIG. 4 shows a representative web former for further processing the porous fiber of the invention to generate a desired fibrous web.

Alternatively, a multiplicity of porous fibers 54 can then be delivered to a conventional web former 46 to generate a desired fibrous web, such as a nonwoven fabric 48. With reference to FIG. 4, for example, the web forming device may be a conventional air-laying apparatus, and the system may, for example, be configured to produce a conventional spunbond fibrous web 48. In the representatively shown configuration, a plurality of porous fibers 54 are delivered to an arrangement of nozzles which can aerodynamically draw and direct the fibers onto a conventional, wire-mesh forming cloth 74. A vacuum box 76 can be located subjacent the forming cloth to help draw the fibers onto the forming mesh, and other mechanisms may be employed to add binders or other treatments onto the airlaid fibers. For example, the web former can include an applicator for incorporating an adhesive or other bonding agent into the fibrous web, and may include a heater to facilitate the in-situ bonding of the resulting web. A system of counter-rotating pattern bonding rollers 80 can optionally be employed to emboss or attach together selected regions of the fibrous web to increase the web integrity. The desired attachments may, for example, be provided by adhesive bonding, thermal bonding, sonic bonding or the like, as well as combinations thereof.

The porous fiber 54, in its various aspects, can exhibit improved combinations of fiber size, pore shape, pore size, pore distribution, fiber tensile strength, fiber elongation-to-break, and fiber toughness (the ability to absorb energy as defined in the *Dictionary of Fiber & Textile Technology*, Hoechst Celanese, 1990).

The method and apparatus of the invention can provide a distinctive porous structure in which the fiber 54 contains voids of elongate, generally ellipsoidal shape. Desirably, the elongate voids have their major axes aligned substantially along a longitudinal dimension of said fiber. In particular aspects of the invention, the elongate voids can have a major axis length which at least about 0.1 microns (μm). Alternatively, the length of the major axis of the voids can be at least about 0.2 μm, and optionally can be at least about 0.25 μm. In other aspects, the length of the major axis of the voids is not more than about 30 μm. Alternatively, the major axis length of the voids can be not more than about 10 μm, and optionally can be not more than about 7 μm.

The method and apparatus of the invention can also provide a porous structure in which the cross-section of the fiber 54 has a distinctive average pore area (per pore). In particular aspects, the fiber pores exhibit an average pore area of not less than about 0.0010 micron$^2$. Alternatively, the fiber pores along the fiber cross-section can exhibit an average pore area of not less than about 0.0020 micron$^2$, and optionally can exhibit an average pore area of not less than about 0.03 micron$^2$. In further aspects, the fiber pores across the fiber cross-section can exhibit an average pore area of not more than about 20 micron$^2$. Alternatively, the pores can exhibit an average pore area of not more than about 10 micron$^2$, and optionally can exhibit an average pore area of not more than about 3 micron$^2$.

The method and apparatus of the invention can also be arranged to provide a porous structure in which the cross-section of the fiber 54 exhibits fiber voids distributed with a distinctive number of pores per unit area of fiber cross-section. In particular aspects, the number of pores per micron$^2$ is not less than about 0.01. Alternatively, the number of pores per micron$^2$ can be not less than about 0.015, and optionally can be not less than about 0.10. In other aspects, the number of pores per micron$^2$ of fiber cross-section can be not more than about 10. Alternatively, the number of pores per micron$^2$ can be not more than about 8, and optionally can be not more than about 5.

Further configurations of the invention can provide a distinctive porous structure in which the cross-section of the fiber 54 exhibits a percent pore area of not less than about 0.1%. Alternatively, the percent pore area can be not less than about 1%, and optionally can be not less than about 2%. In other aspects, the percent pore area can be not more than about 70%. Alternatively, the percent pore area can be not more than about 50%, and optionally can be not more than about 20%.

In addition, the method and apparatus of the invention can provide for a tensile strength of the porous fiber 54 which is not less than about 100 mega-Pascal (MPa). Alternatively, the tensile strength can be not less than about 150 MPa, and optionally can be not less than about 200 MPa. In other aspects, the method and apparatus of the invention can provide for a fiber tensile strength which is not more than about 1000 mega-Pascal (MPa). Alternatively, the fiber tensile strength can be not more than about 750 MPa, and optionally can be not more than about 450 MPa.

In other aspects, the method and apparatus of the invention provides for a porous fiber 54 which can exhibit a percent elongation to break of not less than about 20, as determined with respect to the initial fiber length prior to elongation. Alternatively, the elongation to break can be not less than about 50, and optionally can be not less than about 90. In further aspects, the method and apparatus of the invention provides for a porous fiber 54 which can exhibit a percent elongation to break of not more than about 500. Alternatively, the elongation to break can be not more than about 200, and optionally can be not more than about 160.

Further aspects of the invention can provide for a porous fiber 54 which has a toughness of not less than about 0.1 gram-centimeter per denier-centimeter (g-cm/denier-cm). Alternatively, the fiber toughness can be not less than about 1.5 g-cm/denier-cm, and optionally can be not less than about 2 g-cm/denier-cm. Still further aspects of the invention can provide for a porous fiber 54 which has a toughness of not more than about 20 g-cm/denier-cm. Alternatively, the fiber toughness can be not more than about 10 g-cm/denier-cm, and optionally can be not more than about 5 g-cm/denier-cm.

The following examples are to provide a more detailed understanding of the invention. The examples are representative and are not intended to limit the scope of the invention.

EXAMPLE 1

A resin composed of polypropylene (Himont PF301) (90 wt %) and $TiO_2$ filler particles (SCC 4837 by Standridge Color Corporation) (10 wt %) was intermixed with Dow Corning D193 surfactant (6 wt %, based on the total weight of the filler and resin) by extruding twice through a laboratory, Haake twin-screw extruder. The $TiO_2$ particle size was in the range of 0.1 to 0.5 microns, as measured by a scanning electron microscopy (SEM). The concentrations of the fillers were measured by ashes analysis. The surfactant Dow Corning D193 had a HLB number of 12.2. The fiber spinning process included feeding the combined materials into a hopper and extruding the materials through a single-screw extruder having a length-to-diameter ratio of 24 (L/D=24/1). The extruder had three heating zones, a metering pump, an on-line static mixer, and a spinpack with 4 holes, each hole having a diameter of 0.3 mm. During the spinning extrusion of the fiber, the fiber was subjected to a draw-down ratio of 40. During the quenching of the fiber, the nascent fiber was pre-wetted with a first surface-active liquid delivered through a metering coating die. The first surface-active liquid was a solution composed of isopropanol and water mixed in a ratio of 9-parts isopropanol to 1-part water, by volume. The fiber was then stretched in air by 2× (a draw ratio of 2), followed by stretching by 1.7× (a draw ratio of 1.7) in a bath provided by a second surface-active liquid. The second surface-active liquid was a solution composed of isopropanol and water mixed in a volume ratio of 9-parts isopropanol to 1-part water. The fiber was then heat-set at 80° C. before accumulation onto a winder. The porous fiber denier was about 4.7, and the fiber cross-section exhibited about 0.74 pores per micron$^2$ of fiber cross-section. The mechanical properties of the resultant porous fiber were then measured by a Sintech tensile tester, and are summarized in the following TABLE 1.

TABLE 1

| | |
|---|---|
| Tensile strength | 427 MPa |
| % Elongation to break | 157 |
| Toughness index (g-cm/denier-cm) | 4.2 |

The toughness index represents the ability of the fiber to absorb energy, and is determined by multiplying the fiber tenacity times the fiber elongation-at-break, and then dividing by 2. For example, a typical calculation would be (grams load-at-break×elongation-at-break)/(denier×2), and would have the units (grams-cm)/(denier-cm).

EXAMPLE 2

A resin composed of polypropylene 95.3% (Himont PF301); 1.4% $TiO_2$ concentrate, inorganic filler (SCC 4837 by Standridge Color Corporation) and 3.3 wt. % of powdered polydimethylsilsesquioxane, organic filler (Dow Corning #23 Additive); was intermixed with 6 wt. % (based on the total weight of the filler and resin) of a silicone glycol surfactant (Dow Corning D193) by extruding twice through a laboratory, Haake twin-screw extruder. The particle size of the organic filler ranged from 1 to 5 microns as measured by SEM. The combined material was then extruded through a single-screw extruder (L/D=24/1), which included three heating zones, an on-line static mixer, a metering pump, and a spinpack with 4 holes, each hole having a diameter of 0.3 mm. During the spinning extrusion of the fiber, the fiber was subjected to a draw-down ratio of 33. During the quenching of the fiber, the nascent fiber was pre-wetted with a first surface-active liquid delivered through a metering coating die. The first surface-active liquid was a solution composed of 2 wt. % of a surfactant (IGEPAL RC-630) in a isopropanol/water solvent. The solvent was composed of isopropanol and water mixed in a volume ratio of 9-parts isopropanol to 1-part water. The fiber was then stretched in air by 1.17×, and subsequently stretched by 2× in bath provided by a second surface-active liquid. The second surface-active liquid was a solution composed of isopropanol and water mixed in a ratio of 9-parts isopropanol to 1-part water, by volume. The fiber was then heat-set at 85° C. in an on-line oven before accumulation onto a winder. The porous fiber denier was about 5.7. The mechanical properties of the porous fiber were then measured by a Sintech tensile tester, and are summarized in the following TABLE 2.

TABLE 2

| | |
|---|---|
| Tensile strength | 391 MPa |
| % Elongation to break | 111 |
| Toughness index (g-cm/denier-cm) | 2.7 |

EXAMPLE 3

A resin composed of 93.2 wt. % polypropylene (Himont PF301); 1.4 wt. % $TiO_2$ concentrate (SCC 4837 by Standridge Color Corporation) and 5.4 wt. % $CaCO_3$ (Omyacarb UF from Omya Inc.) which was surface-modified with 6 wt % (based on the weight of the filler) of silicone glycol D193 surfactant was intermixed by extruding twice through a laboratory, Haake twin-screw extruder. The particle sizes of the $CaCO_3$ filler were within the range of 1 to 3 microns, as measured by SEM. The combined material was then extruded through a single-screw extruder (L/D=24/1), which include an on-line static mixer, a metering pump, and a spinpack with 8 holes, each hole having a diameter of 0.3 mm. During the spinning extrusion, the fiber was subjected to a draw-down ratio of 33. During the quenching of the fiber, the nascent fiber was pre-wetted with a first surface-active liquid delivered through a metering coating die. The first surface-active liquid was a solution composed of isopropanol and water mixed in a volume ratio of 9-parts isopropanol to 1-part water. The fiber was then stretched in air by 1.17×, and subsequently stretched 2× stretching in a bath provided by a second quantity of surface-active liquid. The second surface-active liquid was a solution composed of 1 wt % IGEPAL RC-630 in a isopropanol/water solvent. The solvent was composed of isopropanol and water mixed in a volume ratio of 9-parts isopropanol to 1-part water. The fiber was then heat-set at 80° C. before accumulation onto a winder. The porous fiber denier was about 5.8. The mechanical properties of the porous fiber were then measured by a Sintech tensile tester, and are summarized in the following TABLE 3.

TABLE 3

| | |
|---|---|
| Tensile strength | 310 MPa |
| % Elongation to break | 95 |
| Toughness index (g-cm/denier-cm) | 1.8 |

EXAMPLE 4

A resin composed of 88.8 wt % polypropylene (Himont PF301), 1.3 wt % $TiO_2$ concentrate (SCC 4837 by Standridge Color Corporation), and 9.9 wt % $CaCO_3$ (Omyacarb UF from Omya, Inc.) which was surface-modified by 6 wt % (based on the weight of the filler) of silicone glycol D193 surfactant was intermixed by extruding twice through a laboratory, Haake twin-screw extruder. The particle sizes of the $CaCO_3$ were within the range of 1 to 3 microns as measured by SEM. The combined material was then extruded through a single-screw extruder (L/D=24/1), which included three heating zones, an on-line static mixer, a metering pump, and a spinpack with 15 holes, each hole having a diameter of 0.5 mm. During the extrusion-spinning operation, the fiber was subjected to a draw-down ratio of 40. During quenching, the nascent fiber was pre-wetted with a first surface-active liquid delivered through a metering coating die. The first surface-active liquid was composed of a mixture of isopropanol and water provided at a volume ratio of 9.8-parts of isopropanol to 0.2-parts water. The fiber was then stretched in air by 1.5×, and subsequently stretched by 1.4× in a bath provided by a second quantity of surface-active liquid. The second surface-active liquid was composed of isopropanol and water mixed in a volume ratio of 9-parts isopropanol to 1-part water. The fiber was then heat-set at 90° C. with an on-line oven, followed by collecting through a web forming box. The porous fiber denier was about 1.8, and the fiber cross-section exhibited a pore distribution of about 0.19 pores per micron$^2$ of fiber cross-section. The mechanical properties of the porous fiber were then measured by a Sintech tensile tester, and are summarized in the following TABLE 4.

TABLE 4

| | |
|---|---|
| Tensile strength | 358 MPa |
| Elongation % | 150 |
| Toughness index (g-cm/denier-cm) | 3.3 |

Having thus described the invention in rather full detail, it will be readily apparent that various changes and modifications can be made without departing from the spirit of the invention. All of such changes and modifications are contemplated as being within the scope of the invention, as defined by the subjoined claims.

We claim:

1. A method for making porous fiber, comprising a formation-stretching of a substantially continuous fiber while said fiber is in an operative association with an effective formation-quantity of surface-active material;

said fiber having been produced from a source material which includes a thermoplastic, orientable material, and at least about 0.35 wt % of a supplemental material; and said fiber having been pretreated with a prior first quantity of surface-active fluid and incrementally stretched.

2. A method for making porous fiber, comprising:

supplying substantially continuous fiber which has been produced from a source material which includes a thermoplastic, orientable material and at least about 0.35 wt % of a supplemental material;

pretreating said fiber with a first quantity of surface-active fluid;

incrementally stretching said pretreated fiber; and formation-stretching said fiber while said fiber is in an operably effective contact with a second quantity of surface-active fluid.

3. A method as recited in claim 1, wherein said surface-active fluid is a liquid.

4. A method as recited in claim 1, wherein said first quantity of surface-active fluid has been provided with a composition which is substantially the same as a composition of said formation-quantity of surface-active fluid.

5. A method as recited in claim 1, wherein said surface-active fluid provides a surface tension which is less than the critical surface tension of the fiber material.

6. A method as recited in claim 1, wherein said first quantity of surface-active fluid has been provided with a composition which is different than a composition of said formation-quantity of surface-active fluid.

7. A method as recited in claim 1, wherein said fiber has been produced from a source material which includes said thermoplastic, orientable material, and at least about 0.5 wt % of a supplemental material.

8. A method as recited in claim 1, wherein said fiber has been produced from a source material which includes said thermoplastic, orientable material and a supplemental material which provides not less than about 0.5 wt % of a porosity-initiating particulate material, as determined with respect to a total weight of said source material.

9. A method as recited in claim 1, wherein said fiber has been produced from a source material which includes said thermoplastic, orientable material and a supplemental material which includes not less than about 5 wt % of a porosity-initiating particulate material.

10. A method as recited in claim 9, wherein said fiber has been produced from a source material which includes said thermoplastic, orientable material; and a supplemental material which includes at least about 0.1 wt % of a surface-active material.

11. A method as recited in claim 10, wherein said fiber has been produced from a source material which includes said thermoplastic, orientable material; and a supplemental material which provides at least about 1 wt % of a surface-active material.

12. A method as recited in claim 1, wherein said fiber has been produced from a source material which includes said thermoplastic, orientable material and a supplemental material which provides at least about 10 wt % of a porosity-initiating particulate material.

13. A method as recited in claim 1, further comprising a heat-setting of said fiber after said fiber has been stretched.

14. A method as recited in claim 1, further comprising an accumulating of said porous fiber at a rate of at least about 900 m/min.

15. A method as recited in claim 1, further comprising an accumulating of said porous fiber at a rate of at least about 1000 m/min.

16. A method as recited in claim 1, wherein said fiber has been incrementally stretched at a temperature of at least about 10° C.

17. A method as recited in claim 1, wherein said fiber has been incrementally stretched at a draw ratio of not less than about 1.1.

18. A method as recited in claim 1, wherein said fiber has been incrementally stretched at a draw ratio of not more than about 10.

19. A method as recited in claim 1, wherein said formation-stretching provides a draw ratio of not less than about 1.1.

20. A method as recited in claim 1, wherein said formation-stretching provides a draw ratio of not more than about 10.

21. A method as recited in claim 1, wherein said fiber has been subjected to a draw-down ratio of not less than about 5.

22. A method as recited in claim 1, wherein said fiber has been subjected to a draw-down ratio of not more than about 1000.

23. A method as recited in claim 2, wherein said formation-quantity of surface-active fluid is provided as a liquid bath with which said fiber is contacted during said formation-stretching.

24. An apparatus for making porous fiber, comprising:

a source for supplying a substantially continuous fiber which has been produced from a source material which includes a thermoplastic, orientable material and at least about 0.35 wt % of a supplemental material;

an applicator for pretreating said fiber with a first quantity of surface-active fluid;

a first elongating mechanism for incrementally stretching said pretreated fiber;

a mechanism for applying a second quantity of surface-active fluid to said fiber; and a second elongating mechanism for stretching said fiber in while said fiber is in an operably effective contact with a second quantity of surface-active fluid.

25. A method for making porous fiber, comprising:

pretreating a substantially continuous fiber with a first quantity of surface-active fluid;

incrementally stretching said pretreated fiber; and formation-stretching said fiber while said fiber is in an operative contact with a second quantity of a surface-active fluid.

* * * * *

UNITED STATES PATENT AND TRADEMARK OFFICE

CERTIFICATE OF CORRECTION

PATENT NO. : 5,762,840

DATED : June 9, 1998

INVENTOR(S) : Tsai, et al.

It is certified that error appears in the above-identified patent and that said Letters Patent is hereby corrected as shown below:

Column 18, line 66, change "2" to --1--.

Column 18, line 67, change "is" to --has been--.

Column 19, line 1, change "is" to --has been--.

Signed and Sealed this

Ninth Day of March, 1999

*Attest:*

Q. TODD DICKINSON

*Attesting Officer*

*Acting Commissioner of Patents and Trademarks*